US006883479B2

(12) United States Patent
Simpson

(10) Patent No.: US 6,883,479 B2
(45) Date of Patent: Apr. 26, 2005

(54) VCT PHASER HAVING AN ELECTROMAGNETIC LOCK SYSTEM FOR SHIFT AND LOCK OPERATION

(75) Inventor: Roger Simpson, Ithaca, NY (US)

(73) Assignee: Borgwarner Inc., Auburn Hills, MI (US)

( * ) Notice: Subject to any disclaimer, the term of this patent is extended or adjusted under 35 U.S.C. 154(b) by 42 days.

(21) Appl. No.: 10/619,693

(22) Filed: Jul. 15, 2003

(65) Prior Publication Data

US 2004/0083998 A1 May 6, 2004

Related U.S. Application Data

(60) Provisional application No. 60/423,555, filed on Nov. 4, 2002.

(51) Int. Cl.[7] ..... F01L 1/34

(52) U.S. Cl. ..... 123/90.17; 123/90.15; 74/568 R

(58) Field of Search ..... 123/90.12, 90.15–90.18, 123/90.31; 74/568 R; 464/1, 2, 160; 92/121, 122

(56) References Cited

U.S. PATENT DOCUMENTS

| | | | | |
|---|---|---|---|---|
| 4,967,701 A | | 11/1990 | Isogai et al. | 123/90.17 |
| 5,002,023 A | | 3/1991 | Butterfield et al. | 123/90.15 |
| 5,107,804 A | | 4/1992 | Becker et al. | 123/90.17 |
| 5,117,785 A | | 6/1992 | Suga et al. | 123/90.17 |
| 5,172,659 A | | 12/1992 | Butterfield et al. | 123/90.17 |
| 5,184,578 A | | 2/1993 | Quinn, Jr. et al. | 123/90.17 |
| 5,289,805 A | | 3/1994 | Quinn, Jr. et al. | 123/90.17 |
| 5,305,719 A | | 4/1994 | Clarke et al. | 123/90.17 |
| 5,309,873 A | | 5/1994 | Suga et al. | 123/90.17 |
| 5,311,846 A | | 5/1994 | Mueller | 123/90.17 |
| 5,329,890 A | | 7/1994 | Mueller | 123/90.17 |
| 5,361,735 A | | 11/1994 | Butterfield et al. | 123/90.17 |
| 5,497,738 A | | 3/1996 | Siemon et al. | 123/90.17 |
| 5,509,384 A | | 4/1996 | Schmid | 123/90.17 |
| 5,657,725 A | | 8/1997 | Butterfield et al. | 123/90.17 |
| 5,722,356 A | | 3/1998 | Hara | 123/90.17 |
| 5,765,517 A | * | 6/1998 | Wiehl | 123/90.17 |
| 5,785,018 A | * | 7/1998 | Schebitz | 123/90.17 |
| 5,941,202 A | * | 8/1999 | Jung | 123/90.17 |
| 6,053,138 A | | 4/2000 | Trzmiel et al. | 123/90.17 |
| 6,058,897 A | | 5/2000 | Nakayoshi | 123/90.17 |
| 6,062,182 A | | 5/2000 | Ogawa | 123/90.17 |
| 6,247,434 B1 | | 6/2001 | Simpson et al. | 123/90.17 |
| 6,250,265 B1 | | 6/2001 | Simpson | 123/90.17 |
| 6,263,846 B1 | | 7/2001 | Simpson et al. | 123/90.17 |
| 6,311,655 B1 | | 11/2001 | Simpson et al. | 123/90.17 |
| 6,311,658 B1 | * | 11/2001 | Eguchi | 123/90.17 |
| 6,374,787 B1 | | 4/2002 | Simpson et al. | 123/90.17 |
| 6,382,155 B1 | | 5/2002 | Simpson | 123/90.17 |
| 6,477,999 B1 | | 11/2002 | Markley | 123/90.17 |
| 2001/0006050 A1 | | 7/2001 | Heer | 123/90.17 |

FOREIGN PATENT DOCUMENTS

| | | | |
|---|---|---|---|
| DE | 40 07 181 A1 | 9/1991 | F01L/1/34 |
| EP | 1 114 917 A | 7/2001 | F01L/1/34 |

* cited by examiner

*Primary Examiner*—Thomas Denion
*Assistant Examiner*—Jamie Corrigan
(74) *Attorney, Agent, or Firm*—Brown & Michaels, PC; Greg Dziegielewski

(57) ABSTRACT

A locking device is provided to lock the phaser vane and sprocket together at all times except when the phaser is moving from position to position. The locking device ensures that the phaser is locked for start conditions and ensures the prevention of noise from being generated. The locking device also ensures that the timing accuracy of the phaser is controlled at a number of positions for the steady state condition.

9 Claims, 4 Drawing Sheets

VCT PHASER HAVING AN ELECTROMAGNETIC LOCK SYSTEM FOR SHIFT AND LOCK OPERATION

REFERENCE TO RELATED APPLICATIONS

This application claims an invention which was disclosed in Provisional Application No. 60/423,555, filed Nov. 4, 2002, entitled "VCT PHASER HAVING AN ELECTROMAGNETIC LOCK SYSTEM FOR SHIFT AND LOCK OPERATION". The benefit under 35 USC §119(e) of the U.S. provisional application is hereby claimed, and the aforementioned application is hereby incorporated herein by reference.

BACKGROUND OF THE INVENTION

1. Field of the Invention

The invention pertains to the field of an internal combustion engine involving angular relationships of the cam and crank shafts. More particularly, the invention pertains to a variable cam timing (VCT) phaser having an electromagnetic lock system for shift and lock operations.

2. Description of Related Art

The performance of an internal combustion engine can be improved by the use of dual camshafts, one to operate the intake valves of the various cylinders of the engine and the other to operate the exhaust valves. Typically, one of such camshafts is driven by the crankshaft of the engine, through a sprocket and chain drive or a belt drive, and the other of such camshafts is driven by the first, through a second sprocket and chain drive or a second belt drive. Alternatively, both of the camshafts can be driven by a single crankshaft powered chain drive or belt drive. Engine performance in an engine with dual camshafts can be further improved, in terms of idle quality, fuel economy, reduced emissions or increased torque, by changing the positional relationship of one of the camshafts, usually the camshaft which operates the intake valves of the engine, relative to the other camshaft and relative to the crankshaft, to thereby vary the timing of the engine in terms of the operation of intake valves relative to its exhaust valves or in terms of the operation of its valves relative to the position of the crankshaft.

Consideration of information disclosed by the following U.S. Patents, which are all hereby incorporated by reference, is useful when exploring the background of the present invention.

U.S. Pat. No. 5,002,023 describes a VCT system within the field of the invention in which the system hydraulics includes a pair of oppositely acting hydraulic cylinders with appropriate hydraulic flow elements to selectively transfer hydraulic fluid from one of the cylinders to the other, or vice versa, to thereby advance or retard the circumferential position on of a camshaft relative to a crankshaft. The control system utilizes a control valve in which the exhaustion of hydraulic fluid from one or another of the oppositely acting cylinders is permitted by moving a spool within the valve one way or another from its centered or null position. The movement of the spool occurs in response to an increase or decrease in control hydraulic pressure, $P_C$, on one end of the spool and the relationship between the hydraulic force on such end and an oppositely direct mechanical force on the other end which results from a compression spring that acts thereon.

U.S. Pat. No. 5,107,804 describes an alternate type of VCT system within the field of the invention in which the system hydraulics include a vane having lobes within an enclosed housing which replace the oppositely acting cylinders disclosed by the aforementioned U.S. Pat. No. 5,002,023. The vane is oscillatable with respect to the housing, with appropriate hydraulic flow elements to transfer hydraulic fluid within the housing from one side of a lobe to the other, or vice versa, to thereby oscillate the vane with respect to the housing in one direction or the other, an action which is effective to advance or retard the position of the camshaft relative to the crankshaft. The control system of this VCT system is identical to that divulged in U.S. Pat. No. 5,002,023, using the same type of spool valve responding to the same type of forces acting thereon.

U.S. Pat. Nos. 5,172,659 and 5,184,578 both address the problems of the aforementioned types of VCT systems created by the attempt to balance the hydraulic force exerted against one end of the spool and the mechanical force exerted against the other end. The improved control system disclosed in both U.S. Pat. Nos. 5,172,659 and 5,184,578 utilizes hydraulic force on both ends of the spool. The hydraulic force on one end results from the directly applied hydraulic fluid from the engine oil gallery at full hydraulic pressure, $P_S$. The hydraulic force on the other end of the spool results from a hydraulic cylinder or other force multiplier which acts thereon in response to system hydraulic fluid at reduced pressure, $P_C$, from a PWM solenoid. Because the force at each of the opposed ends of the spool is hydraulic in origin, based on the same hydraulic fluid, changes in pressure or viscosity of the hydraulic fluid will be self-negating, and will not affect the centered or null position of the spool.

U.S. Pat. No. 5,289,805 provides an improved VCT method which utilizes a hydraulic PWM spool position control and an advanced control method suitable for computer implementation that yields a prescribed set point tracking behavior with a high degree of robustness.

In U.S. Pat. No. 5,361,735, a camshaft has a vane secured to an end for non-oscillating rotation. The camshaft also carries a timing belt driven pulley which can rotate with the camshaft but which is oscillatable with respect to the camshaft. The vane has opposed lobes which are received in opposed recesses, respectively, of the pulley. The camshaft tends to change in reaction to torque pulses which it experiences during its normal operation and it is permitted to advance or retard by selectively blocking or permitting the flow of engine oil from the recesses by controlling the position of a spool within a valve body of a control valve in response to a signal from an engine control unit. The spool is urged in a given direction by rotary linear motion translating means which is rotated by an electric motor, preferably of the stepper motor type.

U.S. Pat. No. 5,497,738 shows a control system which eliminates the hydraulic force on one end of a spool resulting from directly applied hydraulic fluid from the engine oil gallery at full hydraulic pressure, $P_S$, utilized by previous embodiments of the VCT system. The force on the other end of the vented spool results from an electromechanical actuator, preferably of the variable force solenoid type, which acts directly upon the vented spool in response to an electronic signal issued from an engine control unit ("ECU") which monitors various engine parameters. The ECU receives signals from sensors corresponding to camshaft and crankshaft positions and utilizes this information to calculate a relative phase angle. A closed-loop feedback system which corrects for any phase angle error is preferably employed. The use of a variable force solenoid solves the problem of sluggish dynamic response. Such a device can be designed to be as fast as the mechanical response of the spool valve, and certainly much faster than the conventional (fully hydraulic) differential pressure control system. The faster response allows the use of increased closed-loop gain, making the system less sensitive to component tolerances and operating environment.

U.S. Pat. No. 5,657,725 shows a control system which utilizes engine oil pressure for actuation. The system includes A camshaft has a vane secured to an end thereof for non-oscillating rotation therewith. The camshaft also carries a housing which can rotate with the camshaft but which is oscillatable with the camshaft. The vane has opposed lobes which are received in opposed recesses, respectively, of the housing. The recesses have greater circumferential extent than the lobes to permit the vane and housing to oscillate with respect to one another, and thereby permit the camshaft to change in phase relative to a crankshaft. The camshaft tends to change direction in reaction to engine oil pressure and/or camshaft torque pulses which it experiences during its normal operation, and it is permitted to either advance or retard by selectively blocking or permitting the flow of engine oil through the return lines from the recesses by controlling the position of a spool within a spool valve body in response to a signal indicative of an engine operating condition from an engine control unit. The spool is selectively positioned by controlling hydraulic loads on its opposed end in response to a signal from an engine control unit. The vane can be biased to an extreme position to provide a counteractive force to a unidirectionally acting frictional torque experienced by the camshaft during rotation.

U.S. Pat. No. 6,247,434 shows a multi-position variable camshaft timing system actuated by engine oil. Within the system, a hub is secured to a camshaft for rotation synchronous with the camshaft, and a housing circumscribes the hub and is rotatable with the hub and the camshaft and is further oscillatable with respect to the hub and the camshaft within a predetermined angle of rotation. Driving vanes are radially disposed within the housing and cooperate with an external surface on the hub, while driven vanes are radially disposed in the hub and cooperate with an internal surface of the housing. A locking device, reactive to oil pressure, prevents relative motion between the housing and the hub. A controlling device controls the oscillation of the housing relative to the hub.

U.S. Pat. No. 6,250,265 shows a variable valve timing system with actuator locking for internal combustion engine. The system comprising a variable camshaft timing system comprising a camshaft with a vane secured to the camshaft for rotation with the camshaft but not for oscillation with respect to the camshaft. The vane has a circumferentially extending plurality of lobes projecting radially outwardly therefrom and is surrounded by an annular housing that has a corresponding plurality of recesses each of which receives one of the lobes and has a circumferential extent greater than the circumferential extent of the lobe received therein to permit oscillation of the housing relative to the vane and the camshaft while the housing rotates with the camshaft and the vane. Oscillation of the housing relative to the vane and the camshaft is actuated by pressurized engine oil in each of the recesses on opposed sides of the lobe therein, the oil pressure in such recess being preferably derived in part from a torque pulse in the camshaft as it rotates during its operation. An annular locking plate is positioned coaxially with the camshaft and the annular housing and is moveable relative to the annular housing along a longitudinal central axis of the camshaft between a first position, where the locking plate engages the annular housing to prevent its circumferential movement relative to the vane and a second position where circumferential movement of the annular housing relative to the vane is permitted. The locking plate is biased by a spring toward its first position and is urged away from its first position toward its second position by engine oil pressure, to which it is exposed by a passage leading through the camshaft, when engine oil pressure is sufficiently high to overcome the spring biasing force, which is the only time when it is desired to change the relative positions of the annular housing and the vane. The movement of the locking plate is controlled by an engine electronic control unit either through a closed loop control system or an open loop control system.

U.S. Pat. No. 6,263,846 shows a control valve strategy for vane-type variable camshaft timing system. The strategy involves an internal combustion engine that includes a camshaft and hub secured to the camshaft for rotation therewith, where a housing circumscribes the hub and is rotatable with the hub and the camshaft, and is further oscillatable with respect to the hub and camshaft. Driving vanes are radially inwardly disposed in the housing and cooperate with the hub, while driven vanes are radially outwardly disposed in the hub to cooperate with the housing and also circumferentially alternate with the driving vanes to define circumferentially alternating advance and retard chambers. A configuration for controlling the oscillation of the housing relative to the hub includes an electronic engine control unit, and an advancing control valve that is responsive to the electronic engine control unit and that regulates engine oil pressure to and from the advance chambers. A retarding control valve responsive to the electronic engine control unit regulates engine oil pressure to and from the retard chambers. An advancing passage communicates engine oil pressure between the advancing control valve and the advance chambers, while a retarding passage communicates engine oil pressure between the retarding control valve and the retard chambers.

U.S. Pat. No. 6,311,655 shows multi-position variable cam timing system having a vane-mounted locking-piston device. An internal combustion engine having a camshaft and variable camshaft timing system, wherein a rotor is secured to the camshaft and is rotatable but non-oscillatable with respect to the camshaft is described. A housing circumscribes the rotor, is rotatable with both the rotor and the camshaft, and is further oscillatable with respect to both the rotor and the camshaft between a fully retarded position and a fully advanced position. A locking configuration prevents relative motion between the rotor and the housing, and is mounted within either the rotor or the housing, and is respectively and releasably engageable with the other of either the rotor and the housing in the fully retarded position, the fully advanced position, and in positions therebetween. The locking device includes a locking piston having keys terminating one end thereof, and serrations mounted opposite the keys on the locking piston for interlocking the rotor to the housing. A controlling configuration controls oscillation of the rotor relative to the housing.

U.S. Pat. No. 6,374,787 shows a multi-position variable camshaft timing system actuated by engine oil pressure. A hub is secured to a camshaft for rotation synchronous with the camshaft, and a housing circumscribes the hub and is rotatable with the hub and the camshaft and is further oscillatable with respect to the hub and the camshaft within a predetermined angle of rotation. Driving vanes are radially disposed within the housing and cooperate with an external surface on the hub, while driven vanes are radially disposed in the hub and cooperate with an internal surface of the housing. A locking device, reactive to oil pressure, prevents relative motion between the housing and the hub. A controlling device controls the oscillation of the housing relative to the hub.

U.S. Pat. No. 6,477,999 shows a camshaft that has a vane secured to an end thereof for non-oscillating rotation therewith. The camshaft also carries a sprocket that can rotate with the camshaft but is oscillatable with respect to the camshaft. The vane has opposed lobes that are received in opposed recesses, respectively, of the sprocket. The recesses have greater circumferential extent than the lobes to permit the vane and sprocket to oscillate with respect to one another. The camshaft phase tends to change in reaction to pulses that it experiences during its normal operation, and it is permitted to change only in a given direction, either to advance or retard, by selectively blocking or permitting the flow of pressurized hydraulic fluid, preferably engine oil, from the recesses by controlling the position of a spool within a valve body of a control valve. The sprocket has a passage extending therethrough the passage extending parallel to and being spaced from a longitudinal axis of rotation of the camshaft. A pin is slidable within the passage and is resiliently urged by a spring to a position where a free end of the pin projects beyond the passage. The vane carries a plate with a pocket, which is aligned with the passage in a predetermined sprocket to camshaft orientation. The pocket receives hydraulic fluid, and when the fluid pressure is at its normal operating level, there will be sufficient pressure within the pocket to keep the free end of the pin from entering the pocket. At low levels of hydraulic pressure, however, the free end of the pin will enter the pocket and latch the camshaft and the sprocket together in a predetermined orientation.

Some modern engines are equipped with variable cam Phasers that are hydraulically controlled. When an engine so equipped is trying to start or experiencing periods of low oil pressure the cam phaser may lose control. A locking mechanism to fix the angular relationship between a drive shaft and a driven shaft, such as the cam shaft and the crank shaft, is required to ensure that the phaser maintains positional control and does not make noise during these conditions.

Therefore, it is desirous to lock a phaser at a suitable angular relationship between a drive shaft and a driven shaft with the drive shaft engaging the driven shaft and at the same time maintain a low noise state.

SUMMARY OF THE INVENTION

A device which locks a phaser vane and sprocket together at all times except when the phaser is moving from one angular position to another angular position is provided. Thereby the device ensures that the phaser is locked under certain conditions including start conditions for preventing noise from being generated.

A device which locks the phaser vane and sprocket together is provided. The device ensures the timing accuracy of the phaser, which is controlled at a number of positions of the steady state condition. Steady state condition is the condition wherein a control valve such as a spool valve in which the spool is at null position and the phaser is at its commanded position.

A device is provided with an electromagnetic locking mechanism that employs a pull in style locking mechanism. In addition, the device incorporates a variable force solenoid to control the spool valve of a cam Phaser.

A device is further provided with an electromagnetic locking mechanism that employs a variable force locking mechanism. In addition, the device incorporates a variable force solenoid to control the control spool of a cam Phaser.

Accordingly, a locking device is provided for maintaining a fixed angular relationship between a driving shaft and a driven shaft, the locking device being adapted to be used in an internal combustion engine. The locking device includes a variable camshaft timing phaser having a center mounted spool valve, wherein a null position is hydraulically controlled, the phaser having a plurality of angular relationships. The locking device further includes an electromagnetic locking mechanism, and a locking plate interposed between the phaser and the locking mechanism.

DETAILED DESCRIPTION OF THE INVENTION

Figure 1A:
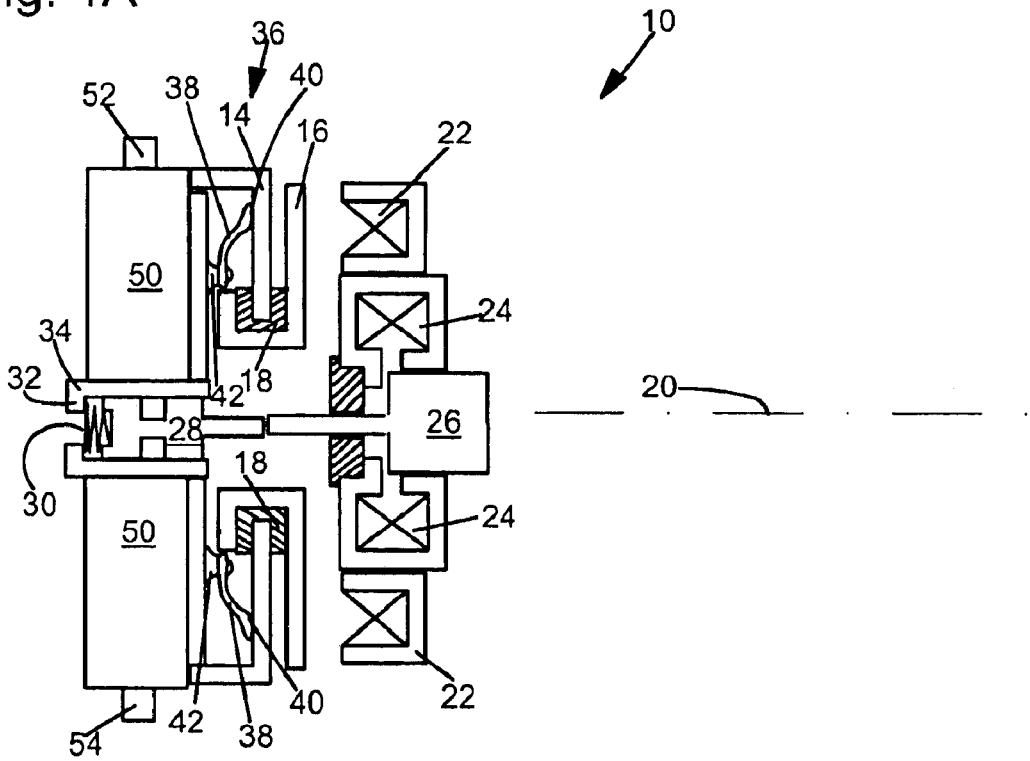
FIG. 1*a* shows a side view of a pull in style lock coil integrated with phaser mechanism at locking position.

Referring to FIGS. 1*a*, 1*b*, 2*a*, and 2*b*, an electromagnetic locking mechanism 10 that employs a pull in style locking mechanism 12 is shown. Pull in style locking mechanism 12 includes a lock plate 14 coupled to a secondary plate 16 with a bearing 18 interposed therebetween. Secondary plate 16 is made of materials such as ferromagnetic materials for suitable activation by an energized coil. Secondary plate 16 is further rotable with lock plate 14 in relation to a center line 20.

Pull in style locking mechanism 12 is capable of magnetically engaging with a lock coil 22. More specifically, lock coil 22 is disposed to pull the secondary plate 16 toward the same along with the pull in style locking mechanism 12, which is in turn rigidly coupled to a phaser as shown infra. Lock coil 22, along with coil 24 of a control solenoid, are concentrically (in relation to 20) mounted together on an outer wall (not shown). The control solenoid comprises coil 24 and an actuation member 26 which actuates or exerts a variable force upon a first end 28*a* of a spool 28. Spool 28 has a seat at the other end for engaging an elastic element 30 such as a metal spring. Elastic element 30 has one end engaging spool 28 via the seat and another end resting on a seat 32 connected to a spool valve bore (34).

A strap drive 36 includes a strap 38 which has a first end 40 that engages lock plate 14. Strap 38 further includes a second end mounted on a seat 42 which is connected to a phaser 50. Lock plate 14 may have teeth or protrusions for engaging phaser 50 which possess notches or receiving elements for receiving the teeth to thereby stop relative rotational movements between phaser 50 and lock plate 14. Phaser 50 includes timing gear having teeth 52, 54 (only two shown) positioned around its circumference.

By way of an example, in a VCT system a lock detent of 5 degrees can give 7 discrete locking positions. Therefore, when the lock detent is disengaged or unlocked, the angular relationship such as the ones between the cam and crank shafts can be fixed at 7 angular relationships. Based on the above, several embodiments can be achieved. The first embodiment is an electromagnetic locking mechanism that employs a pull in style locking mechanism. The second embodiment is another electromagnetic locking mechanism that employs a variable force locking mechanism. Both embodiments incorporate a variable force solenoid to control the control spool valve of the cam Phaser.

Both lock mechanisms include a coil and magnetic path that pulls the locking plate away from the VCT Phaser. When the lock coil is "on" or energized, the Phaser is unlocked and is free to move. When the lock coil is "off" or de-energized, the Phaser is locked through the lock plate engagement through a strap mechanism. In both designs the lock solenoid 22 or 22*a* and control solenoid 24 are mounted together to the front cover (not shown).

The first electromagnetic lock plate design 10 pulls a secondary plate 16 towards the coil 22. This secondary plate 16 needs to be able to rotate relative to the lock plate 14 through a bearing 18. The secondary plate 16 rotation is stopped once it is pulled in.

Figure 1B:
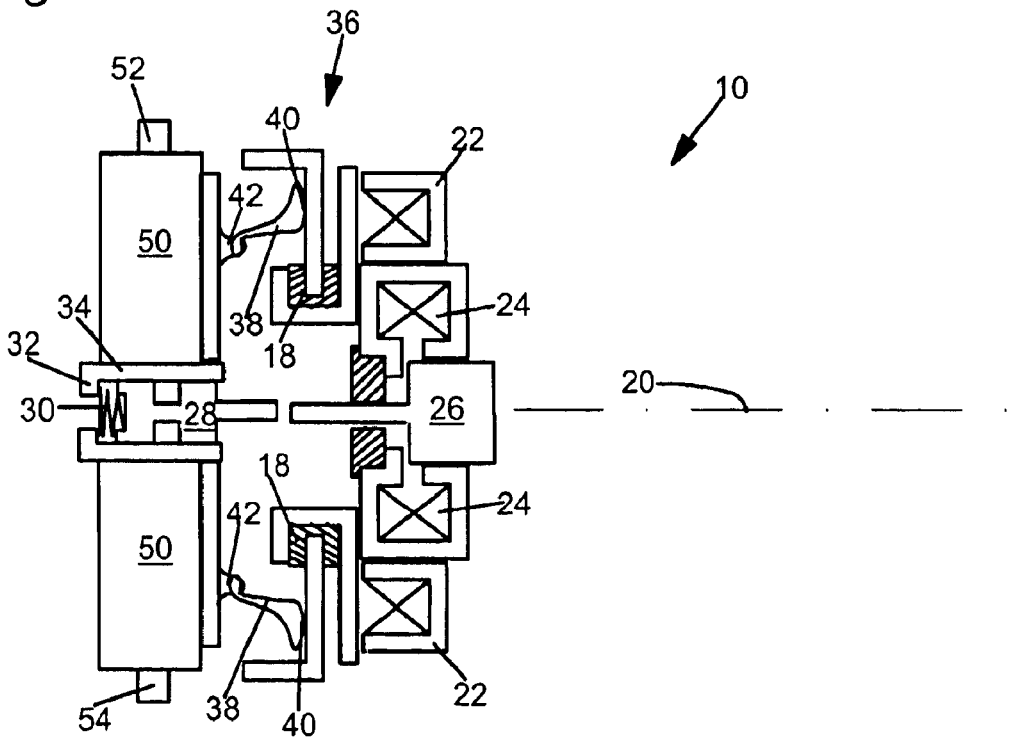
FIG. 1*b* shows a side view of a pull in style lock coil integrated with phaser mechanism of FIG. 1*a* at non-locking position.
Figure 2A:
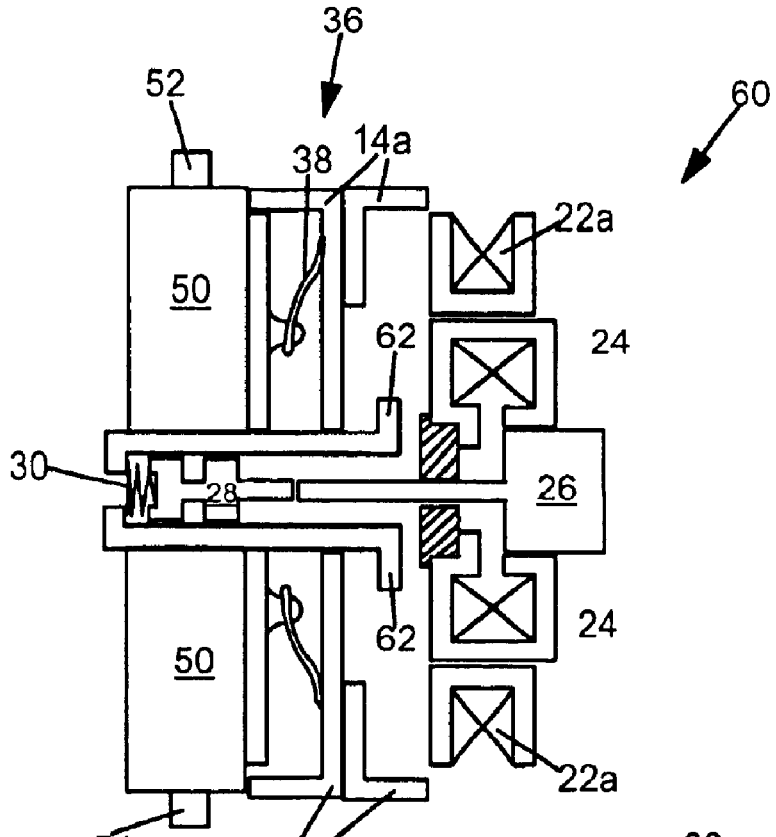
FIG. 2*a* shows a side view of a pull in style lock coil integrated with phaser mechanism having a plate with lock teeth at locking position.
Figure 2B:
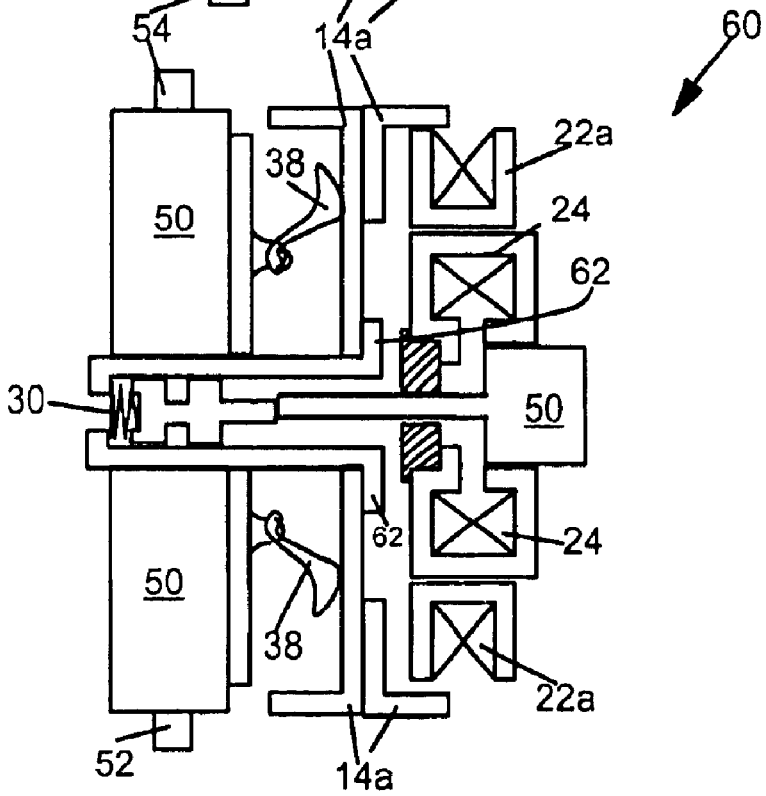
FIG. 2*b* shows a side view of a pull in style lock coil integrated with phaser mechanism having a plate with lock teeth at non-locking position.

Referring specifically to FIGS. 2*a* and 2*b*, a second embodiment of the electromagnetic lock plate design 60 is shown, in which a lock plate 14*a* is pulled toward the coil 22*a* but is free from ever touching the coil 22*a*. This way the bearing 18 and secondary plate 16 of FIGS 1*a* and 1*b* are not required. The magnetic force exerted by the coil is proportional to the travel of the lock plate 14*a*. In other word, FIGS. 2*a* and 2*b* show another method to pull the lock plate away form the phaser. This style of solenoid can pull the lock plate away from the phaser but does not have the same high force at the end of the stroke that the first solenoid has when the lock plate is pulled away. Therefore, coil 22*a* of the solenoid may be a variable force solenoid.

One reason for using the second embodiment is that because under certain conditions Phaser 50 can be in the wrong position when the engine stops (e.g. stall condition). Phaser 50 then needs to be unlocked during engine cranking so that Phaser 50 can be moved back to base timing. However, either embodiment will unlock the phaser so it can move back to the correct base timing during cranking.

It is noted that the identical numerals of FIGS 1*a* and 1*b* constitutes substantially identical parts of FIGS. 2*a* and 2*b* with identical numerals.

Figure 3:
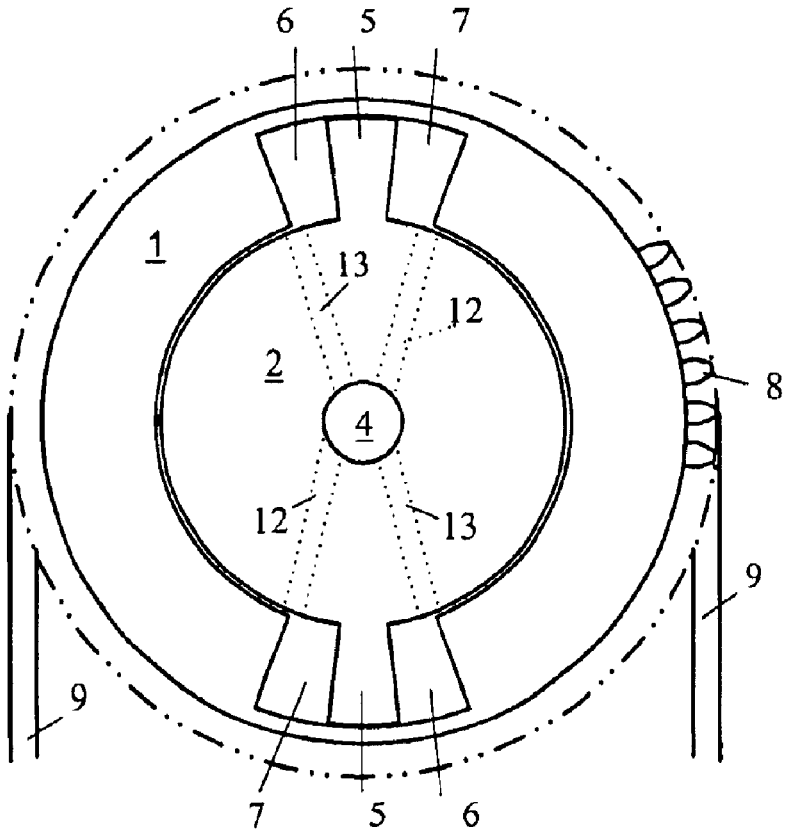
FIG. 3 shows a phaser schematic view of the present invention.

Referring to FIG. 3, one possible embodiment in schematic form of phaser 50 is shown a vane-type VCT phaser comprises a housing 1, the outside of which has sprocket teeth 8 which mesh with and are driven by timing chain 9. Inside the housing 1, a cavity including fluid chambers 6 and 7 is defined. Coaxially within the housing 1, free to rotate relative to the housing, is a rotor 2 with vanes 5 which fit between the chambers 6 and 7, and a central control valve 4 which routes pressurized oil via passages 12 and 13 to chambers 6 and 7, respectively. Pressurized oil introduced by valve 4 into passages 12 will push vanes 5 counterclockwise relative to the housing 1, forcing oil out of chambers 6 into passages 13 and into valve 4. It will be recognized by one skilled in the art that this description is common to vane phasers in general, and the specific arrangement of vanes, chambers, passages and valves shown in the instant figure may be varied within the teachings of the invention. For example, the number of vanes and their location can be changed, some phasers have only a single vane, others as many as a half dozen, and the vanes might be located on the housing and reciprocate within chambers on the rotor. The housing might be driven by a chain or belt or gears, and the sprocket teeth might be gear teeth or a toothed pulley for a belt.

Figure 4:
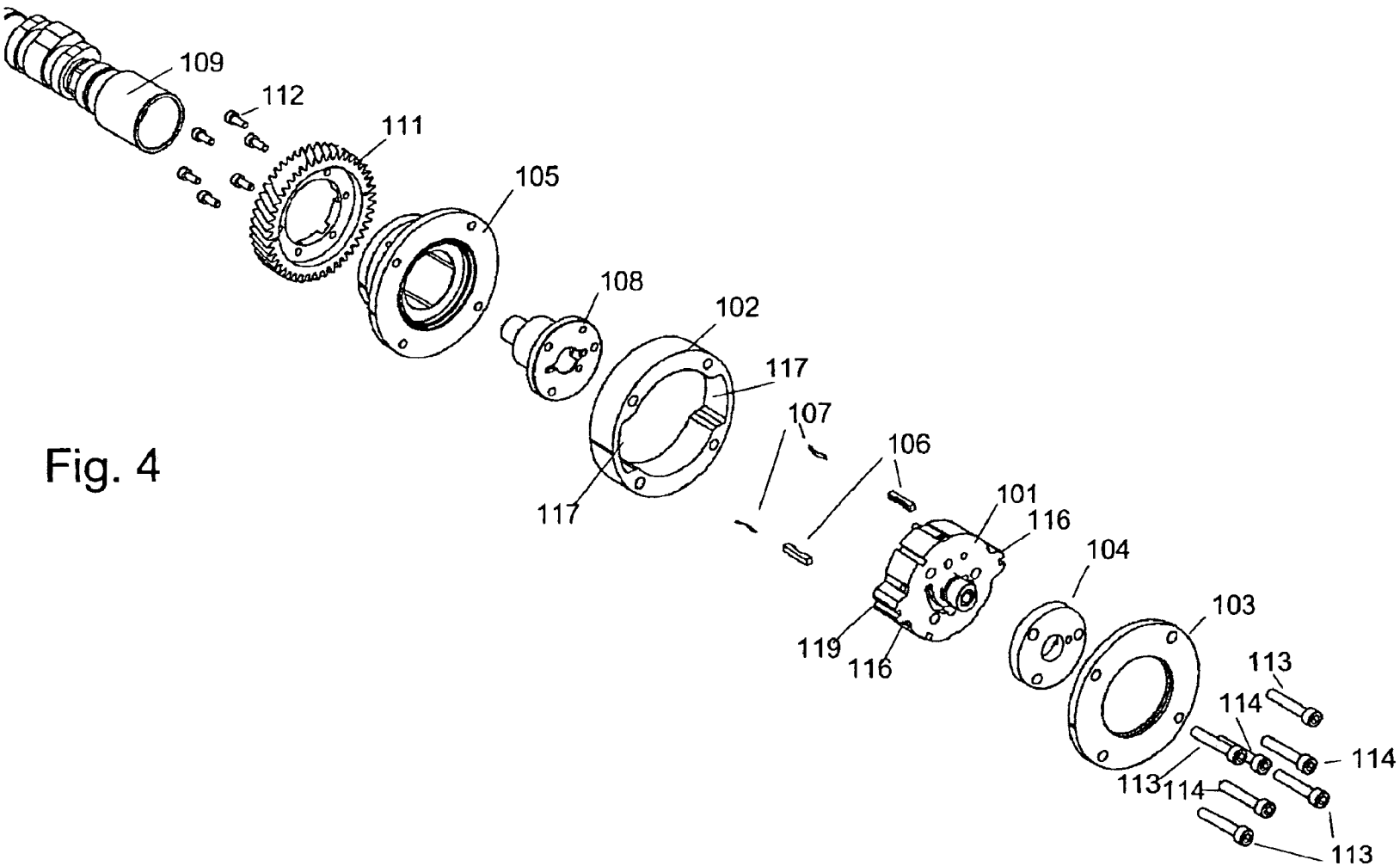
FIG. 4 shows a blow up view of a phaser of the present invention.

Referring to FIG. 4, a blow up view of a phaser suitable for the present invention is shown. A rotor 101 is fixedly positioned on the camshaft 109, by means of mounting flange 108, to which it (and rotor front plate 104) is fastened by screws 114. The rotor 1 has a diametrically opposed pair of radially outwardly projecting vanes 116, which fit into recesses 117 in the housing body 102. The inner plate 105, housing body 102, and outer plate 103 are fastened together around the mounting flange 108, rotor 101 and rotor front plate 104 by screws 113, so that the recesses 117 holding the vanes 116, enclosed by outer plate 103 and inner plate 105, form fluid-tight chambers. The timing gear 111 is connected to the inner plate 105 by screws 112. Collectively, the inner plate 105, housing body 102, outer plate 103 and timing gear 111 may be referred to as the "housing". The housing may be coupled to a driving shaft which may be a crank shaft or another cam shaft. Further, cam shaft 109 may itself be a driving shaft.

The following are terms and concepts relating to the present invention.

It is noted the hydraulic fluid or fluid referred to supra are actuating fluids. Actuating fluid is the fluid which moves the vanes in a vane phaser. Typically the actuating fluid includes engine oil, but could be separate hydraulic fluid. The VCT system of the present invention may be a Cam Torque Actuated (CTA)VCT system in which a VCT system that uses torque reversals in camshaft caused by the forces of opening and closing engine valves to move the vane. The control valve in a CTA system allows fluid flow from advance chamber to retard chamber, allowing vane to move, or stops flow, locking vane in position. The CTA phaser may also have oil input to make up for losses due to leakage, but does not use engine oil pressure to move phaser. Vane is a radial element actuating fluid acts upon, housed in chamber. A vane phaser is a phaser which is actuated by vanes moving in chambers.

There may be one or more camshaft per engine. The camshaft may be driven by a belt or chain or gears or another camshaft. Lobes may exist on camshaft to push on valves. In a multiple camshaft engine, most often has one shaft for exhaust valves, one shaft for intake valves. A "V" type engine usually has two camshafts (one for each bank) or four (intake and exhaust for each bank).

Chamber is defined as a space within which vane rotates. Camber may be divided into advance chamber (makes valves open sooner relative to crankshaft) and retard chamber (makes valves open later relative to crankshaft). Check valve is defined as a valve which permits fluid flow in only one direction. A closed loop is defined as a control system which changes one characteristic in response to another, then checks to see if the change was made correctly and adjusts the action to achieve the desired result (e.g. moves a valve to change phaser position in response to a command from the ECU, then checks the actual phaser position and moves valve again to correct position). Control valve is a valve which controls flow of fluid to phaser. The control valve may exist within the phaser in CTA system. Control valve may be actuated by oil pressure or solenoid. Crankshaft takes power from pistons and drives transmission and camshaft. Spool valve is defined as the control valve of spool type. Typically the spool rides in bore, connects one passage to another. Most often the spool is located on center axis of rotor of a phaser. In addition, for other type of phaser such as OPA phaser that uses a remote mounted 4way spool valve and solenoid, the spool may not be located on center axis of the rotor.

Differential Pressure Control System (DPCS) is a system for moving a spool valve, which uses actuating fluid pressure on each end of the spool. One end of the spool is larger than the other, and fluid on that end is controlled (usually by a Pulse Width Modulated (PWM) valve on the oil pressure), full supply pressure is supplied to the other end of the spool (hence differential pressure). Valve Control Unit (VCU) is a control circuitry for controlling the VCT system. Typically the VCU acts in response to commands from ECU.

Driven shaft is any shaft which receives power (in VCT, most often camshaft). Driving shaft is any shaft which supplies power (in VCT, most often crankshaft, but could drive one camshaft from another camshaft). ECU is Engine Control Unit that is the car's computer. Engine Oil is the oil used to lubricate engine, pressure can be tapped to actuate phaser through control valve.

Housing is defined as the outer part of phaser with chambers. The outside of housing can be pulley (for timing belt), sprocket (for timing chain) or gear (for timing gear). Hydraulic fluid is any special kind of oil used in hydraulic cylinders, similar to brake fluid or power steering fluid. Hydraulic fluid is not necessarily the same as engine oil. Typically the present invention uses "actuating fluid". Lock pin is disposed to lock a phaser in position. Usually lock pin is used when oil pressure is too low to hold phaser, as during engine start or shutdown.

Oil Pressure Actuated (OPA) VCT system uses a conventional phaser, where engine oil pressure is applied to one side of the vane or the other to move the vane.

Open loop is used in a control system which changes one characteristic in response to another (say, moves a valve in response to a command from the ECU) without feedback to confirm the action.

Phase is defined as the relative angular position of camshaft and crankshaft (or camshaft and another camshaft, if phaser is driven by another cam). A phaser is defined as the entire part which mounts to cam. The phaser is typically made up of rotor and housing and possibly spool valve and check valves. A piston phaser is a phaser actuated by pistons in cylinders of an internal combustion engine. Rotor is the inner part of the phaser, which is attached to a cam shaft.

Pulse-width Modulation (PWM) provides a varying force or pressure by changing the timing of on/off pulses of current or fluid pressure. Solenoid is an electrical actuator which uses electrical current flowing in coil to move a mechanical arm. Variable force solenoid (VFS) is a solenoid whose actuating force can be varied, usually by PWM of supply current. VFS is opposed to an on/off (all or nothing) solenoid.

Sprocket is a member used with chains such as engine timing chains. Timing is defined as the relationship between the time a piston reaches a defined position (usually top dead center (TDC)) and the time something else happens. For example, in VCT or VVT systems, timing usually relates to when a valve opens or closes. Ignition timing relates to when the spark plug fires.

Torsion Assist (TA)or Torque Assisted phaser is a variation on the OPA phaser, which adds a check valve in the oil supply line (i.e. a single check valve embodiment) or a check valve in the supply line to each chamber (i.e. two check valve embodiment). The check valve blocks oil pressure pulses due to torque reversals from propagating back into the oil system, and stop the vane from moving backward due to torque reversals. In the TA system, motion of the vane due to forward torque effects is permitted; hence the expression "torsion assist" is used. Graph of vane movement is step function.

VCT system includes a phaser, control valve(s), control valve actuator(s) and control circuitry. Variable Cam Timing (VCT) is a process, not a thing, that refers to controlling and/or varying the angular relationship (phase) between one or more camshafts, which drive the engine's intake and/or exhaust valves. The angular relationship also includes phase relationship between cam and the crankshafts, in which the crankshaft is connected to the pistons.

Variable Valve Timing (VVT) is any process which changes the valve timing. VVT could be associated with VCT, or could be achieved by varying the shape of the cam or the relationship of cam lobes to cam or valve actuators to cam or valves, or by individually controlling the valves themselves using electrical or hydraulic actuators. In other words, all VCT is VVT, but not all VVT is VCT.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A locking device for maintaining a fixed angular relationship between a driving shaft and a driven shaft, the locking device being adapted to be used in an internal combustion engine, the locking device comprising:

a variable camshaft timing phaser having a center mounted spool valve, wherein a null position is hydraulically controlled, the phaser having a plurality of angular relationships;

an electro-magnetic locking mechanism, wherein within a predetermined range of rotation along any segment of the whole 360° circumference of the phaser any point therein is disposed to be the locking position, thereby when the locking device is disengaged the fixed angular relationship is maintained; and a locking plate interposed between the phaser and the locking mechanism.

2. The locking device of claim 1 further comprising a second plate rotably coupled the locking plate during an unlock state.

3. The locking device of claim 1 further comprising a strap drive interposed between the phaser and the locking plate for biasing the locking device toward the electro-magnetic locking mechanism.

4. The locking device of claim 1 further comprising a stopping element for preventing the locking plate from direct contact with the electro-magnetic locking mechanism.

5. The locking device of claim 1, wherein the electro-magnetic locking mechanism comprising a coil.

6. The locking device of claim 1, wherein the angular relationships include the angular relationship between a cam shaft and the crank shaft, or two cam shafts.

7. The locking device of claim 1, wherein the driven shaft is a cam shaft.

8. The locking device of claim 1, wherein the driving shaft is a crank shaft.

9. The locking device of claim 1, wherein the driving shaft is a cam shaft.

* * * * *

UNITED STATES PATENT AND TRADEMARK OFFICE

CERTIFICATE OF CORRECTION

PATENT NO. : 6,883,479 B2
DATED : April 26, 2005
INVENTOR(S) : Simpson

It is certified that error appears in the above-identified patent and that said Letters Patent is hereby corrected as shown below:

Title page,
Item [73], Assignee, should read -- BorgWarner Inc., Auburn Hills, MI (US) --

Signed and Sealed this

Ninth Day of August, 2005

JON W. DUDAS
*Director of the United States Patent and Trademark Office*